US006884339B2

(12) United States Patent
Benazzi et al.

(10) Patent No.: US 6,884,339 B2
(45) Date of Patent: Apr. 26, 2005

(54) FLEXIBLE METHOD FOR PRODUCING OIL BASES WITH A ZSM-48 ZEOLITE

(75) Inventors: Eric Benazzi, Chatou (FR); Pierre Marion, Antony (FR); Alain Billon, Le Vesinet (FR); Christophe Gueret, St Romain en Gal (FR); Jean-Claude Hipeaux, Colombes (FR); Jean Paul Gouzard, Rueil Malmaison (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 321 days.

(21) Appl. No.: 10/018,526

(22) PCT Filed: Apr. 20, 2001

(86) PCT No.: PCT/FR01/01221

§ 371 (c)(1),
(2), (4) Date: Jul. 18, 2002

(87) PCT Pub. No.: WO01/81508

PCT Pub. Date: Nov. 1, 2001

(65) Prior Publication Data

US 2002/0189972 A1 Dec. 19, 2002

(30) Foreign Application Priority Data

Apr. 21, 2000 (FR) ..... 00 05214

(51) Int. Cl.[7] ..... C10G 69/02
(52) U.S. Cl. ..... 208/58; 208/89
(58) Field of Search ..... 208/58, 89

(56) References Cited

U.S. PATENT DOCUMENTS

| | | | | |
|---|---|---|---|---|
| 4,062,758 A | * | 12/1977 | Goudriaan et al. | 208/80 |
| 4,225,461 A | * | 9/1980 | Cosyns et al. | 502/223 |
| 4,347,121 A | | 8/1982 | Mayer et al. | |
| 5,302,279 A | * | 4/1994 | Degnan et al. | 208/87 |
| 5,358,627 A | | 10/1994 | Mears et al. | |
| 5,468,368 A | | 11/1995 | Baker, Jr. et al. | |

FOREIGN PATENT DOCUMENTS

| | | |
|---|---|---|
| EP | 0590672 | 4/1994 |
| FR | 2785616 | 5/2000 |
| WO | 95 10578 | 4/1995 |
| WO | 98 02503 | 1/1998 |

* cited by examiner

*Primary Examiner*—Walter D. Griffin
(74) *Attorney, Agent, or Firm*—Millen, White, Zelano & Branigan, P.C.

(57) ABSTRACT

A process for the production of very high quality base oils optionally with simultaneous production of high quality middle distillates comprises the stages for hydrotreatment, preferably hydrocracking, on Y or beta zeolite, and atmospheric distillation. The effluent is subjected to a catalytic dewaxing on the ZSM-48 catalyst. The process then comprises a hydrofinishing stage for hydrogenating the aromatic compounds, preferably on a catalyst that comprises at least one noble metal of group VIII, chlorine and fluorine, and the stages of atmospheric and vacuum distillation. The hydrofinishing stage is conducted at a temperature lower by 20–200° C. than the catalytic dewaxing stage.

24 Claims, 2 Drawing Sheets

FLEXIBLE METHOD FOR PRODUCING OIL BASES WITH A ZSM-48 ZEOLITE

This invention relates to an improved process for the production of very high quality base oils, i.e., that have a high viscosity index (VI), a low content of aromatic compounds, good UV stability and a low pour point, from petroleum fractions that have a boiling point of greater than 340° C., with optionally simultaneously the production of middle distillates (gas oils, kerosene in particular) that are of very high quality, i.e., that have a low content of aromatic compounds and a low pour point. The process according to the invention uses a catalyst with a ZSM-48 base for catalytic dewaxing.

RELEVANT PRIOR ART

High-quality lubricants have an essential importance for good operation of modern machines, automobiles, and trucks.

These lubricants are most often obtained by a series of refining stages that allow the improvement of the properties of a petroleum fraction. In particular, a treatment of heavy petroleum fractions with high contents of linear or slightly branched paraffins is necessary to obtain good quality base oils with the best possible yields, by an operation that aims at eliminating the linear or very slightly branched paraffins from the feedstocks that will then be used as base oils.

Actually, the paraffins of high molecular weight that are linear or very slightly branched and that are present in the oils give rise to high pour points and therefore to solidification phenomena for low-temperature applications. To reduce the values of the pour points, these linear paraffins that may or may not be very slightly branched should be eliminated completely or partially.

This operation can be carried out by extraction via solvents such as mixtures of toluene/methyl-ethylketone or methyl-isobutyl ketone: dewaxing with methyl ethyl-ketone (MEK) or with methyl-isobutyl ketone (MIBK) is then mentioned. These techniques, however, are costly, not always easy to use and lead to the formation of by-products, crude paraffins.

Another means is the catalytic treatment in the presence or the absence of hydrogen, and, taking into account their shape selectivity, the zeolites are among the most used catalysts.

Catalysts with a zeolite base, such as ZSM-5, ZSM-11, ZSM-12, ZSM22, ZSM-23, ZSM-35 and ZSM-38, have been described for their use in these processes.

OBJECT OF THE INVENTION

Research efforts were thus directed to the development of an improved process for the production of very high quality lubricating oils.

This invention therefore relates to a scheme of processes for the joint production of very high quality base oils and very high quality middle distillates (gas oils in particular). The oils that are obtained have a high viscosity index (VI), a low content of aromatic compounds, low volatility, good UV stability and a low pour point, starting from petroleum fractions that have a boiling point of greater than 340° C.

In particular and contrary to the usual process schemes or obtained from the prior art, this process is not limited in the quality of oil products that it may obtain; in particular, a judicious selection of operating conditions makes it possible to obtain white medicinal grade oils (i.e., of excellent quality). More specifically, the invention relates to a process for the production of high quality oils and optionally high quality middle distillates from a hydrocarbon feedstock including at least 20% of end volume above 340° C., a process that comprises the following successive stages:

(a) Hydrotreatment carried out at a temperature of 330–450° C., under a pressure of 5–25 MPa, with a volumetric flow rate of 0.1–6 $h^{-1}$, in the presence of hydrogen in the hydrogen/hydrocarbon volumetric ratio of 100–2000, and in the presence of an amorphous catalyst that comprises at least one metal of group VIII and at least one metal of group VI B, (b) hydrocracking, without intermediate separation of the effluent that is obtained at the end of the hydrotreatment, whereby the hydrocracking is carried out at a temperature of 340–430° C., under a pressure of 5–25 MPa, with a volumetric flow rate of 0.1–5 h−1, in the presence of hydrogen, and in the presence of a catalyst that contains at least one zeolite and that also contains at least one element of group VIII and at least one element of group VI B, (c) atmospheric distillation of the effluent that is obtained at the end of the hydrocracking to separate the gases from the liquid, (d) catalytic dewaxing of at least one liquid fraction that is obtained by atmospheric distillation and that contains compounds with a boiling point of higher than 340° C., dewaxing at a temperature of 200–500° C., under a total pressure of 1–25 MPa, with an hourly volumetric flow rate of 0.05–50 h−1, with 50–2000 l of hydrogen/l of feedstock, in the presence of a catalyst that comprises a zeolite that is selected from the group that is formed by zeolites ZSM-48, EU-12, EU-11 and ZBM-30, (e) the dewaxed effluent is directly subjected to a hydrofinishing treatment that is carried out at a temperature of 180–400° C., which is lower than the catalytic dewaxing temperature by at least 20° C. and at most 200° C., under a total pressure of 1–25 MPa, with an hourly volumetric flow rate of 0.05–100 $h^{-1}$, in the presence of 50–2000 liters of hydrogen/liter of feedstock, and in the presence of an amorphous catalyst for the hydrogenation of aromatic compounds, comprising at least one metal that is selected from the group of metals of group VIII and metals of group VI B, (f) the effluent that is obtained from the hydrofinishing treatment is subjected to a distillation stage that comprises an atmospheric distillation and a vacuum distillation so as to separate at least one oil fraction at a boiling point of higher than 340° C. and that has a pour point of lower than −10° C., a content by weight of aromatic compounds that is less than 2% and a VI that is greater than 95, a viscosity at 100° C. of at least 3 cSt (or 3 $mm^2/s$) and so as optionally to separate at least one middle distillate fraction that has a pour point of less than or equal to −20° C., a content of aromatic compounds of at most 2% by weight and a content of polyaromatic compounds of at most 1% by weight.

DETAILED DESCRIPTION OF THE INVENTION

The process according to the invention comprises the following stages:

Stage (a): Hydrotreatment

The hydrocarbon feedstock from which the oils and optionally the middle distillates of high quality are obtained contains at least 20% boiling volume above 340° C.

Very varied feedstocks can therefore be treated by the process.

The feedstock can be, for example, LCO (light cycle oils), vacuum distillates that are obtained from direct distillation of crude or conversion units such as the FCC, coker or visbreaking, or that come from aromatic compound extraction units or that come from desulfurization or hydroconversion of RAT (atmospheric residues) and/or RSV (vacuum residues), or else the feedstock can be a deasphalted oil, or else any mixture of the above-cited feedstocks. The list above is not limiting. In general, the feedstocks that are suitable for the target oils have an initial boiling point of higher than 340° C., and better yet higher than 370° C.

In a first step, the feedstock is subjected to a hydrotreatment, during which it is brought into contact, in the presence of hydrogen, with at least one catalyst that comprises an amorphous substrate and at least one metal that has a hydro-dehydrogenating function that is ensured by, for example, at least one element of group VI B and at least one element of group VIII, at a temperature of between 330 and 450° C., preferably 360–420° C., under a pressure of between 5 and 25 MPa, preferably less than 20 MPa, whereby the volumetric flow rate is between 0.1 and 6 $h^{-1}$, preferably 0.3–3 $h^{-1}$, and the amount of hydrogen that is introduced is such that the hydrogen/hydrocarbon volumetric ratio is between 100 and 2000.

During the first stage, the use of a catalyst that favors the hydrogenation relative to cracking, used under suitable thermodynamic and kinetic conditions, makes possible a significant reduction of the condensed polycyclic aromatic hydrocarbon content. Under these conditions, the majority of the nitrogen- and sulfur-containing products of the feedstock are also transformed. This operation therefore makes it possible to eliminate two types of compounds of which it is known that they are inhibitors of the zeolitic catalyst that is used in the process below.

By carrying out a precracking of the feedstock to be treated, this first stage makes it possible to adjust the properties of the oil base at the outlet of this first stage based on the quality of the oil base that it is desired to obtain at the outlet of the process. Advantageously, it will be possible to carry out this adjustment by manipulating the nature and the quality of the catalyst that is used in the first stage and/or the temperature of this first stage so as to raise the viscosity index for the oil base, fraction with a boiling point of higher than 340° C., at the outlet of this stage. The viscosity index that is obtained, before dewaxing, is preferably between 80 and 150 and, better, between 90 and 140, and even 90 and 130.

The substrate generally has a base of (preferably essentially consists of) amorphous alumina or silica-alumina; it may also contain boron oxide, magnesium oxide, zirconium oxide, titanium oxide or a combination of these oxides. The hydro-dehydrogenating function is preferably performed by at least one metal or metal compound of groups VIII and VI, preferably selected from among: molybdenum, tungsten, nickel and cobalt.

This catalyst advantageously can contain phosphorus; actually, it is known in the prior art that the compound provides two advantages to hydrotreatment catalysts: an ease in preparation particularly during the impregnation of nickel and molybdenum solutions, and a better hydrogenation activity.

The preferred catalysts are the NiMo and/or NiW catalysts on alumina, also the NiMo and/or NiW catalysts on alumina that is doped with at least one element that is included in the group of atoms formed by phosphorus, boron, silicon and fluorine, or else the catalysts NiMo and/or NiW on silica-alumina, or on silica-alumina-oxide of titanium that is doped or not by at least one element that is included in the group of atoms formed by phosphorus, boron, fluorine and silicon.

The total concentration of metal oxides of groups VI and VIII is between 5 and 40% by weight and preferably between 7 and 30%, and the ratio by weight that is expressed in terms of metal oxide between group VI metal (or metals) vs. group VIII metal (or metals) is preferably between 20 and 1.25 and even more preferably between 10 and 2. The concentration of phosphorus oxide $P_2O_5$ will be less than 15% by weight and preferably 10% by weight.

The product that is obtained at the end of this first stage is sent to a second catalyst in a second stage without intermediate separation of ammonia ($NH_3$) and hydrogen sulfide ($H_2S$), or distillation.

Stage (b): Hydrocracking

The effluent that is obtained from first stage (a) is introduced completely onto the catalyst of second stage (b) in the presence of hydrogen where it is hydrocracked in the presence of a bifunctional catalyst that comprises a zeolitic acid function and a hydro-dehydrogenating metallic function.

During this stage, the polyaromatic and polynaphthenoaromatic compounds that are partially and/or totally hydrogenated during the first stage are hydrocracked on the acid sites to result in the formation of paraffins. These paraffins in the presence of a bifunctional catalyst can undergo an isomerization then optionally a hydrocracking to result respectively in the formation of isoparaffins and lighter cracking products.

The conversion of polyaromatic compounds with several cores requires hydrogenation prior to their cracking.

The second stage catalyst comprises a zeolite, a substrate and a hydro-dehydrogenating function.

The hydro-dehydrogenating function is advantageously obtained by a combination of metals of groups VI B (for example molybdenum and/or tungsten) and/or metals of group VIII that are preferably non-noble (for example, cobalt and/or nickel) of the periodic table. This catalyst preferably may also contain at least one promoter element that is deposited on the surface of the catalyst, an element included in the group formed by phosphorus, boron and silicon and advantageously phosphorus.

The total concentration of metals of groups VI B and VIII, expressed in terms of metal oxides relative to the substrate, is generally between 5 and 40% by weight, preferably between 7 and 30% by weight. The ratio by weight (expressed in terms of metal oxides) of group VIII metals to group VIB metals is preferably between 0.05 and 0.8; preferably between 0.13 and 0.5.

This type of catalyst advantageously may contain phosphorus, whose content, expressed in terms of phosphorus oxide $P_2O_5$ relative to the substrate, generally will be less than 15% by weight, preferably less than 10% by weight.

The contents of boron and silicon are less than 15% by weight and preferably less than 10% by weight (expressed in terms of oxide).

The amorphous or poorly crystallized substrate is selected from the group that is formed by alumina, silica, silica alumina, alumina-boron oxide, magnesia, silica-magnesia, zirconium, titanium oxide, clay, by themselves or in mixtures.

The zeolite is advantageously selected from the group that is formed by the Y zeolite (FAU-structural type, faujasite)

and the beta zeolite (BEA-structural type) according to the nomenclature developed in "Atlas of Zeolites Structure Types," W. M. Meier, D. H. Olson and Ch. Baerlocher, 4th Revised Edition 1996, Elsevier.

The content by weight of zeolite is between 2 and 80% and preferably between 3 and 50% relative to the final catalyst, and advantageously between 3–25%.

The zeolite optionally can be doped with metal elements such as, for example, the metals of the family of rare earths, in particular lanthanum and cerium, or noble or non-noble metals of group VIII, such as platinum, palladium, ruthenium, rhodium, iridium, iron and other metals such as magnesia, zinc, and magnesium.

A particularly advantageous H-Y acid zeolite is characterized by different specifications: an $SiO_2/Al_2O_3$ molar ratio of between about 6 and 70 and preferably between about 12 and 15: a sodium content of less than 0.15% by weight determined on the zeolite that is calcined at 1 100° C.; a crystalline parameter has elementary mesh of between $24.58\times10^{-10}$ m and $24.24\times10^{-10}$ m and preferably between $24.38\times10^{-10}$ m and $24.26\times10^{-10}$ m; a CNa capacity for sodium ion uptake, expressed in terms of gram of Na per 100 grams of modified zeolite, neutralized then calcined, greater than about 0.85; a specific surface area that is determined by the B.E.T. method at greater than about 400 $m^2/g$ and preferably greater than 550 $m^2/g$, a water vapor adsorption capacity at 25° C. for a partial pressure of 2.6 torrs (or 34.6 MPa), greater than about 6%, a pore distribution, determined by nitrogen physisorption, comprising between 5 and 45% and preferably between 5 and 40% of the total pore volume of the zeolite that is contained in the pores with a diameter of between $20\times10^{-10}$ m and $80\times10^{-10}$ m, and between 5 and 45% and preferably between 5 and 40% of the total pore volume of the zeolite that is contained in pores with a diameter of greater than $80\times10^{-10}$ m and generally less than $1000\times10^{-10}$ m, whereby the remainder of the pore volume is contained in the pores with a diameter of less than $20\times10^{-10}$ m.

A preferred catalyst essentially contains at least one metal of group VI, and/or at least one non-noble metal of group VIII, the Y zeolite and alumina.

An even more preferred catalyst essentially contains nickel, molybdenum, a Y zeolite as defined above and alumina.

The operating conditions in which this second stage (b) is carried out are significant.

The pressure will be maintained between 5 and 25 MPa, advantageously between 5 and 20 MPa and preferably 7 to 15 MPa, and the volumetric flow rate will be between 0.1 $h^{-1}$ and 5 $h^{-1}$ and preferably between 0.5 and 4.0 $h^{-1}$.

The temperature is adjusted in second stage (b) to obtain the desired viscosity and V.I. It is between 340 and 430° C., and in general it is advantageously between 370 and 420° C.

These two stages (a) and (b) can be carried out on the two types of catalysts in (two or more) different reactors, or preferably on at least two catalytic beds that are installed in the same reactor.

The hydrogen is separated from the effluent at the outlet of the hydrocracker, and the effluent then directly undergoes an atmospheric distillation (stage c) to separate the gases (such as ammonia and hydrogen sulfide ($H_2S$) that are formed, as well as the other light gases that would be present, optionally hydrogen . . . ). At least one liquid fraction that contains products whose boiling point is greater than 340° C. is obtained.

It is advantageously possible to distill at atmospheric pressure to obtain several fractions (gasoline, kerosene, gas oil, for example), with a boiling point of at most 340° C. and a fraction (called residue) with an initial boiling point of higher than 340° C. (and, even better, higher than 370° C.).

This fraction has a VI, before dewaxing, that is between 95 and 165 and preferably at least 110.

According to the invention, this fraction (residue) will then be treated in the catalytic dewaxing stage, i.e., without undergoing vacuum distillation.

In a variant of the process, the residue undergoes, before being dewaxed catalytically, an extraction of aromatic compounds (that constitute a stage (c'). This extraction is carried out by any known means, and the most used solvents are furfurol and N-methylpyrrolidone.

The naphthenoaromatic compounds are thus extracted, and the raffinate that is obtained has a viscosity index that is higher than that of the residue that is part of the extraction stage. By this operation, the VI of the product that is obtained at the end of the hydrofinishing stage is also increased.

In another embodiment that is more aimed at producing middle distillates, the cutpoint is lowered, and instead of cutting at 340° C. as above, it will be possible to include gas oils and optionally kerosenes in the fraction that contains the compounds that boil above 340° C. For example, a fraction with an initial boiling point of at least 150° C. is obtained.

In contrast, the residue can undergo an extraction of aromatic compounds before being dewaxed catalytically. This extraction is carried out by any known means, whereby the furfurol is most often used. The usual operating conditions are used.

The raffinate that is obtained has a viscosity index that is higher than the starting residue index. The VI of the product obtained at the end of the hydrofinishing is thus also increased.

The fraction that is thus obtained that contains said compounds will be treated directly by catalytic dewaxing, whereby the other fractions (150° C.) are or are not treated separately by catalytic dewaxing in this embodiment.

In a general way, in this text middle distillates are called the fraction(s) with initial boiling points of at least 150° C. and final boiling points that go just up to the residue, i.e., generally up to 340° C. or preferably to 370° C.

One advantage of this conversion process (hydrotreatment and hydrocracking) that is described (therefore using a zeolitic-type catalyst) is that it generally makes it possible to produce lubricating oil bases that have a viscosity that is higher than the one that is obtained by an amorphous catalyst at the same conversion. During the hydrocracking process, the viscosity at 100° C. of the fraction that has a boiling point higher than 340° C., unconverted, and preferably higher than 370° C., is a decreasing function of the conversion level that is obtained.

When this conversion level is high (beyond 70%), the viscosity of the residue that is obtained with an amorphous catalyst is such that it is not possible to use it to produce the most viscous grades of lubricating oils (500 N and Bright Stock). This limitation disappears when the zeolitic catalyst that is described above is used.

Thus, the ratio between the viscosity at 100° C. of the hydrocracking residue 370° C.+, obtained by a process that uses only non-zeolitic catalysts ($V_{100A}$), and the viscosity at 100° C. of the hydrocracking residue 370° C.+, obtained by our process ($V_{100Z}$) and at the same conversion this ratio ($V_{100A}/V_{100Z}$), is strictly less than 1, preferably between 0.95 and 0.4.

Stage (d): Catalytic Hydrodewaxing (HDPC)

The fraction that contains the compounds that boil above 340° C., as defined above, obtained from the second stage and the atmospheric distillation (c) is then subjected, at least partly and preferably totally, to a catalytic dewaxing stage in the presence of hydrogen and a hydrodewaxing catalyst comprising an acid function and a hydro-dehydrogenating metallic function and at least one matrix.

We note that the compounds that boil above 340° C. are always subjected to catalytic dewaxing.

The acid function is ensured by at least one zeolite that is selected from the group that is formed by the ZSM-48, EU-2, EU-11 and ZBM-30 zeolites.

The use of said zeolites makes possible in particular the production of products with low pour points and high viscosity indices with good yields within the framework of the process according to the invention.

The content by weight of molecular sieve in the hydrodewaxing catalyst is between 1 and 90%, preferably between 5 and 90% and even more preferably between 10 and 85%.

By way of examples and in a nonlimiting way, the matrices that are used for carrying out the shaping of the catalyst are alumina gels, aluminas, magnesia, amorphous silica-aluminas and mixtures thereof. Techniques such as extrusion, pelletizing or sugar-coating can be used for carrying out the shaping operation.

The catalyst also comprises a hydro-dehydrogenating function that is ensured by, for example, at least one element of group VIII and preferably at least one element that is in the group formed by platinum and palladium. The content by weight of non-noble metal of group VIII, relative to the final catalyst, is between 1 and 40%, preferably between 10 and 30%. In this case, the non-noble metal is often associated with at least one metal of group VIB (Mo and W are preferred). If at least one noble metal of group VIII is involved, the content by weight, relative to the final catalyst, is less than 5%, preferably less than 3% and even more preferably less than 1.5%.

In the case of use of noble metals of group VIII, the platinum and/or the palladium are preferably located on the matrix, defined as above.

The hydrodewaxing catalyst according to the invention can also contain 0 to 20%, preferably 0 to 10% by weight (expressed in terms of oxides) of phosphorus. The combination of group VI B metal(s) and/or group VIII metal(s) with phosphorus is particularly advantageous.

The hydrocracking residue (i.e., the fraction with an initial boiling point of higher than 340° C.), which is obtained in stage (c) of the process according to the invention and which is to be treated in this hydrodewaxing stage (d), has the following characteristics: it has an initial boiling point of higher than 340° C. and preferably higher than 370° C., a pour point of at least 15° C., a nitrogen content of less than 10 ppm by weight, a sulfur content of less than 50 ppm by weight, or even better, 10 ppm by weight, a viscosity index of 35 to 165 (before dewaxing), preferably at least equal to 110 and even more preferably less than 150, a content of aromatic compounds that is less than 10% by weight, and a viscosity at 100° C. of greater than or equal to 3 cSt ($mm^2/s$).

These characteristics are also those of the residue that would be obtained by atmospheric distillation of a sample of a liquid fraction that contains the compounds with a boiling point of higher than 340° C., whereby said fraction has an initial boiling point of less than or equal to 340° C. and undergoes catalytic dewaxing.

The operating conditions under which the hydrodewaxing stage of the process of the invention operates are as follows:

The reaction temperature is between 200 and 500° C. and preferably between 250 and 470° C., advantageously 270–430° C.;

the pressure is between 0.1 and 25 MPa ($10^6$ Pa) and preferably between 1.0 and 20 MPa;

the hourly volumetric flow rate (vvh expressed by volume of feedstock injected per unit of volume of catalyst and per hour) is between about 0.05 and about 50 and preferably between about 0.1 and about 20 $h^{-1}$ and even more preferably between 0.2 and 10 $h^{-1}$.

They are selected to obtain the desired pour point.

The contact between the feedstock entering into dewaxing and the catalyst is carried out in the presence of hydrogen. The hydrogen level that is used and expressed in liters of hydrogen per liter of feedstock is between 50 and about 2000 liters of hydrogen per liter of feedstock and preferably between 100 and 1500 liters of hydrogen per liter of feedstock.

One skilled in the art knows that the improvement of the pour point of the oil bases, regardless of whether it is obtained by the solvent dewaxing process (DPS) or by a catalytic hydrodewaxing process (HDPC), causes a reduction of the viscosity index (VI).

One of the characteristics of the process according to the invention is that:

The variation of VI during the catalytic hydrodewaxing stage (HDPC) is preferably greater than or equal to 0 for the same pour point, or when a reduction of VI is observed during the catalytic hydrodewaxing stage (HDPC), this reduction is less than that that can be observed in the case of a solvent dewaxing (DPS) to obtain the same pour point. Thus, the ratio between the variation of VI, of the oil base, during the catalytic dewaxing stage, and the variation of VI, of the oil base, during the solvent dewaxing stage, $\Delta VI_{HDPC}/\Delta VI_{DPS}$, is strictly less than 1 for the same pour point.

Stage (e): Hydrofinishing

The effluent at the outlet of the catalytic hydrodewaxing stage is, as a whole and without intermediate distillation, sent to a hydrofinishing catalyst in the presence of hydrogen to carry out an intense hydrogenation of the aromatic compounds that degrade the stability of oils and distillates. The acidity of the catalyst should be weak enough, however, not to lead to the formation of cracking product with a boiling point of less than 340° C. so as not to degrade the final yields of oils in particular.

The catalyst that is used in this stage comprises at least one metal of group VIII and/or at least one element of group VIB of the periodic table. The strong metallic functions: platinum and/or palladium, or nickel-tungsten combinations or nickel-molybdenum combinations will advantageously be used to carry out an intense hydrogenation of the aromatic compounds.

These metals are deposited and dispersed on an amorphous or crystalline oxide-type substrate, such as, for example, aluminas, silicas, silica-aluminas.

The hydrofinishing catalyst (HDF) can also contain at least one element of the VII A group of the periodic table. These catalysts preferably contain fluorine and/or chlorine.

The metal contents by weight are between 10 and 30% in the case of non-noble metals and less than 2%, preferably between 0.1 and 1.5%, and even more preferably between 0.1 and 1.0%, in the case of noble metals.

The total amount of halogen is between 0.02 and 30% by weight, advantageously 0.01 to 15%, or even 0.01 to 10%, preferably 0.01 to 5%.

Among the catalysts that can be used in this HDF stage and that lead to excellent performances, in particular for obtaining medicinal oils, it will be possible to cite the catalysts that contain at least one noble metal of group VIII (platinum, for example) and at least one halogen (chlorine and/or fluorine), whereby the chlorine and fluorine combination is preferred.

The operating conditions under which the hydrofinishing stage of the process of the invention operates are as follows:

The reaction temperature is between 180 and 400° C. and preferably between 210 and 350° C., advantageously 230–320° C.;

the pressure is between 0.1 and 25 MPa ($10^6$ Pa) and preferably between 1.0 and 20 MPa;

the hourly volumetric flow rate (vvh expressed in terms of volume of feedstock injected per unit of volume of catalyst and per hour) is between about 0.05 and about 100 and preferably between about 0.1 and about 30 $h^{-1}$.

The contact between the feedstock and the catalyst is carried out in the presence of hydrogen. The hydrogen level that is used and expressed in terms of liters of hydrogen per liter of feedstock is between 50 and about 2000 liters of hydrogen per liter of feedstock and preferably between 100 and 1500 liters of hydrogen per liter of feedstock.

One of the characteristics of the process according to the invention is that the temperature of the HDF stage is less than the temperature of the catalytic hydrodewaxing stage (HDPC). The $T_{HDPC}-T_{HDF}$ difference is generally between 20 and 200, and preferably between 30 and 100° C.

The effluent at the outlet of the HDF stage is sent into the distillation train, which integrates an atmospheric distillation and a vacuum distillation, whose purpose is to separate the conversion products with a boiling point of less than 340° C. and preferably less than 370° C. (and including in particular those that are deformed during the catalytic hydrodewaxing stage (HDPC)) from the fraction that constitutes the oil base and whose initial boiling point is higher than 340° C. and preferably higher than 370° C.

Furthermore, this vacuum distillation section makes it possible to separate the different oil grades.

The base oils that are obtained according to this process have a pour point of less than −10° C., a content by weight of aromatic compounds that is less than 2%, a VI that is greater than 95, preferably greater than 110 and even more preferably greater than 120, a viscosity of at least 3.0 cSt at 100° C., an ASTM color that is less than 1 and a UV stability such that the increase of the ASTM color is between 0 and 4 and preferably between 0.5 and 2.5.

The UV stability test, adapted to the ASTM D925-55 and D1148-55 processes, provides a quick method for comparing the stability of the lubrication oils that are exposed to an ultraviolet ray source. The test chamber consists of a metallic chamber that is equipped with a turntable that receives the oil samples. An ampoule that produces the same ultraviolet rays as those of sunlight and that is placed at the top of the test chamber is directed toward the bottom on the samples. Included among the samples is a standard oil with known UV characteristics. The ASTM D1500 color of the samples is determined at t=0 and then after 45 hours of exposure at 55° C. The results are transcribed for the standard sample and the samples of the test are as follows:

a) ASTM D1500 initial color, b) ASTM D1500 final color, c) deepening of color, d) cloudiness, e) precipitated.

Another advantage of the process according to the invention is that it is possible to reach very low aromatic compound contents, less than 2% by weight, preferably 1% by weight, and, even better, less than 0.05% by weight) and even to go to the production of white oils of medicinal quality that have aromatic compound contents that are less than 0.01% by weight. These oils have UV absorbance values at 275, 295 and 300 nanometers or less than 0.8, 0.4 and 0.3 (ASTM D2008 method) and a Saybolt color of between 0 and 30.

In a particularly advantageous way, therefore, the process according to the invention also makes it possible to obtain medicinal white oils. The medicinal white oils are mineral oils that are obtained by an intense refining of the petroleum; their quality is subjected to different regulations that aim at guaranteeing their safety for pharmaceutical applications; they lack toxicity and are characterized by their density and their viscosity. The medicinal white oils essentially comprise saturated hydrocarbons, they are chemically inert and their aromatic hydrocarbon content is low. Special attention is brought to aromatic compounds and in particular to six polycyclic aromatic hydrocarbons (P.A.H. for the English abbreviation of polycyclic aromatic hydrocarbons) that are toxic and present at concentrations of one part per billion by weight of aromatic compounds in the white oil. The monitoring of the total content of aromatic compounds can be carried out by the ASTM D 2008 method; this UV adsorption test at 275, 292 and 300 nanometers makes it possible to monitor a lower absorbance respectively at 0.8, 0.4 and 0.3 (i.e., the white oils have aromatic compound contents that are lower than 0.01% by weight). These measurements are made with concentrations of 1 g of oil per liter, in a 1 cm tank. The marketed white oils differ by their viscosity but also by their original crude which may be paraffinic or naphthenic; these two parameters will induce differences both in the physico-chemical properties of the white oils that are considered but also in their chemical composition.

The oil fractions, regardless of whether they are obtained from the direct distillation of a crude oil followed by an extraction of aromatic compounds by a solvent or whether they are obtained from a catalytic hydrorefining process or hydrocracking process, also now contain non-negligible amounts of aromatic compounds. Within the current legislative framework of the majority of industrialized countries, the so-called medicinal white oils should have an aromatic compound content that is lower than a threshold that is imposed by the legislation of each of the countries. The absence of these aromatic compounds in the oil fractions is reflected by a Saybolt color specification that should be approximately at least 30 (+30), a maximum UV adsorption specification that should be less than 1.60 to 275 nm in a pure product of a 1 centimeter tank and a maximum absorption specification of products for extraction by DMSO that should be less than 0.1 for the U.S. market (Food and Drug Administration, Standard No. 1211145). This last test consists in extracting specifically polycyclic aromatic hydrocarbons with a polar solvent, often DMSO, and in monitoring their content in the extract by a UV absorption measurement in the range of 260–350 nm.

The middle distillates that are obtained have improved pour points (less than or equal to −20° C.), low aromatic compound contents (at most 2% by weight), (di and more) polyaromatic compound contents of less than 1% by weight and, for the gas oils, a cetane index of higher than 50 and even higher than 52.

Another advantage of the process according to the invention is that the total pressure can be the same in all of the reactors, creating the possibility of working in series and using a single unit and therefore reducing costs.

BRIEF DESCRIPTION OF FIGURES

The process is illustrated in FIGS. 1 and 2, whereby

In FIG. 1, the feedstock enters via pipe (1) into a hydrotreatment zone (2) (which can consist of one or more reactors and comprise one or more catalytic beds of one or more catalysts) in which the hydrogen enters (for example via pipe (3)) and where hydrotreatment stage (a) is carried out.

Figure 1:
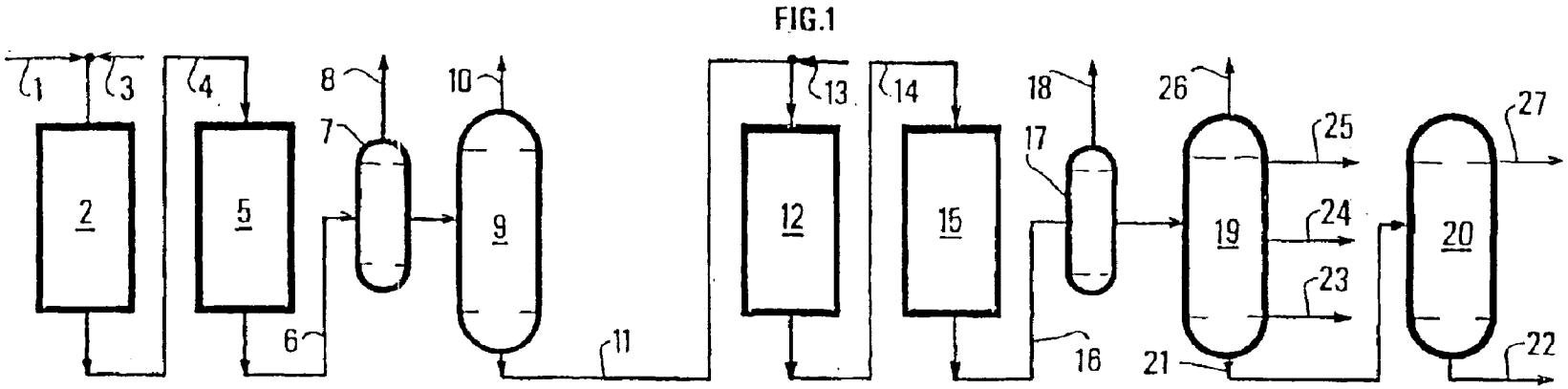
FIG. 1 shows the treatment of the entire liquid fraction of hydrodewaxing and FIG. 2 that of a hydrocracking residue.

The hydrotreated feedstock is transferred via pipe (4) into hydrocracking zone (5) (which can consist of one or more reactors and comprise one or more catalytic beds of one or more catalysts) where hydrocracking stage (b) is carried out in the presence of hydrogen.

The effluent that is obtained from zone (5) is sent via a pipe (6) into a flask (7) for separating the hydrogen that is extracted via a pipe (8), and the effluent is then distilled at atmospheric pressure in column (9) from where the gaseous fraction is extracted at the top via pipe (10). Stage (c) of the process is thus carried out.

At the bottom of the column, a liquid fraction is obtained that contains the compounds with a boiling point of higher than 340° C. This fraction is evacuated via pipe (11) to catalytic dewaxing zone (12).

Catalytic dewaxing zone (12) (comprising one or more reactors, one or more catalytic beds of one or more catalysts) also receives hydrogen via a pipe (13) for carrying out stage (d) of the process.

The effluent that exits this zone via a pipe (14) is sent directly into hydrofinishing zone (15) (comprising one or more reactors, one or more catalytic beds of one or more catalysts), from where it exits via a pipe (16). Hydrogen can be added, if necessary, in zone (15) where stage (e) of the process is carried out.

The effluent that is obtained is separated in a distillation train (stage f of the process) that also comprises flask (17) for separating the hydrogen via a pipe (18), an atmospheric distillation column (19) and a vacuum column (20) that treats the atmospheric distillation residue that is transferred via pipe (21), residue with an initial boiling point of higher than 340° C.

The following are obtained as products at the end of the distillation steps: an oil fraction (pipe 22) and lower-boiling fractions, such as gas oil (pipe 23), kerosene (pipe 24), gasoline (pipe 25); the light gases that are eliminated via pipe (26) from the atmospheric column and the gases that are eliminated via column (27) by vacuum distillation.

To declutter the figure, the hydrogen recycling has not been shown, whether at flask (7) toward hydrotreatment and/or hydrocracking, and/or at flask (17) toward dewaxing and/or hydrofinishing.

Figure 2:
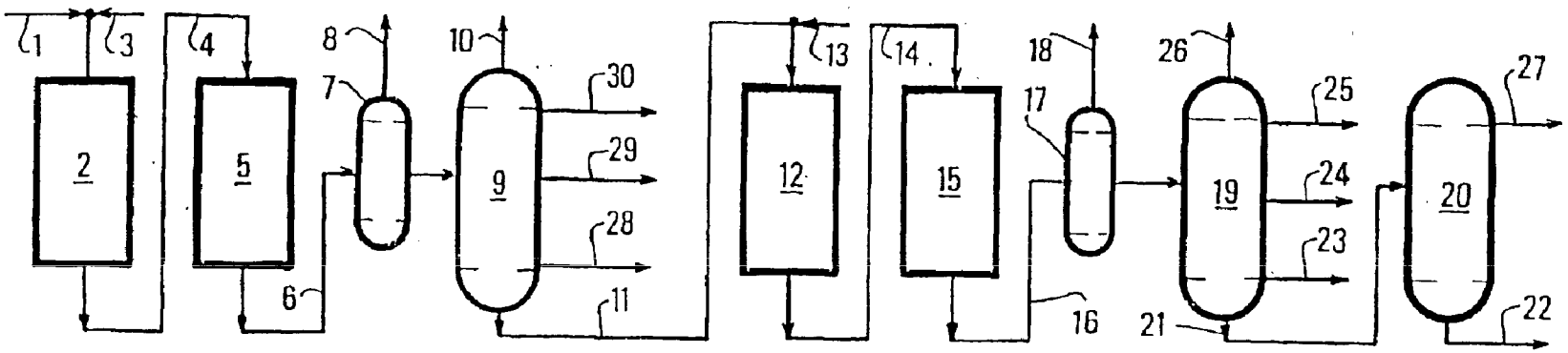

The references of FIG. 1 are recognized in FIG. 2. The difference lies at the distillation level of the effluent that is obtained from hydrocracking stage (b) that exits via pipe (6). After the hydrogen is separated in flask (7), it is separated by an atmospheric distillation in a column (9) of gases that are extracted via pipe (10). The distillation is conducted so as to obtain a residue with an initial boiling point of higher than 340° C. that exits via duct (11) and to obtain gas oil fractions (duct 28), kerosene (duct 29) and gasoline (duct 30).

Only the residue is treated in dewaxing zone (12).

The recycling steps described below are entirely transposable.

There is shown here a diagram of the conversion unit with two reactors without recycling the effluent that exits from hydrocracker (5).

It is also possible to recycle a portion of this effluent to the hydrotreatment stage that is carried out in zone (2) and/or to the hydrocracking stage that is carried out in zone (5).

The user will adapt the recycling rate to his target "products" to promote the production of oils or rather of middle distillates.

The hydrotreatment and hydrocracking zones are also frequently found in the same reactor. Consequently, the transfer of the hydrotreated effluent is done directly in the absence of pipe (4). A recycling of the effluent is always possible either to the hydrotreatment zone (upstream from a catalyst bed) or to the hydrocracking zone.

In another embodiment of this conversion stage (hydrocracking in two stages), the residue that exits via pipe (11) and that has an initial boiling point of higher than 340° C. (as shown in FIG. 2), is sent, at least partly, into an additional hydrocracking zone (32), different from zone (5) (comprising one or more reactors, one or more catalytic beds of one or more catalysts). This other hydrocracking zone can contain the same catalyst as zone (5) or another catalyst.

The resulting effluent is recycled to the atmospheric distillation stage.

The other portion of the residue with an initial boiling point of higher than 340° C. is transferred to the catalytic dewaxing stage.

Figure 3:
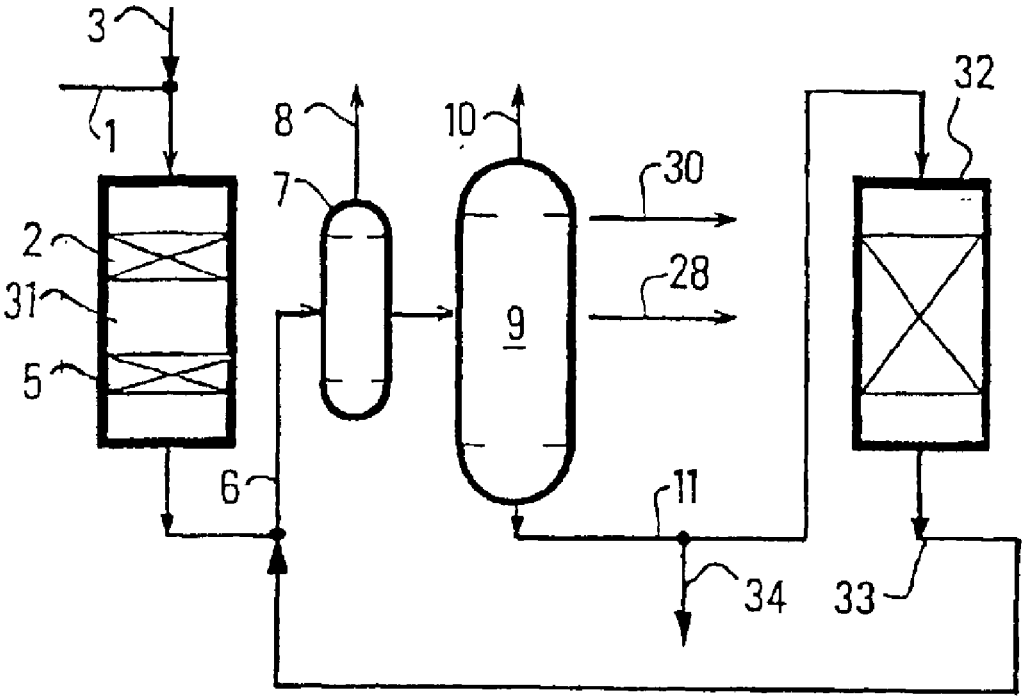
FIG. 3 illustrates an embodiment employing an additional hydrocracking stage.

In FIG. 3, these possible methods of the conversion unit are diagrammed by incorporating the same references as used in FIG. 2, which will not be described again here.

The residue that exits column (9) via pipe (11) is sent into other hydrocracking zone (32), from where an effluent comes out into a duct (33) that is recycled in column (9). The residue that is sent into dewaxing zone (12) exits via a branched pipe (34) on pipe (11).

FIG. 3 also showed the embodiment in same reactor (31) of hydrotreatment zones (2) and hydrocracking zones (5), but separate zones are entirely possible in combination with additional hydrocracking zone (32).

The conversion unit of FIG. 3 can thus be substituted with the conversion unit of FIG. 2, whereby the hydrodewaxing stages, hydrofinishing stages and the distillation train were unchanged. All of the additional possibilities (H2 recycling . . . ) are transposable.

In another variant of FIG. 2 or 3, the residue that exits duct (11) is sent into the extraction unit of aromatic compounds (35) equipped with a pipe (36) for the input of solvent, a pipe (37) for the output of solvent and a pipe (38) by which the raffinate that is sent into catalytic dewaxing zone (12) exits.

Figure 4:
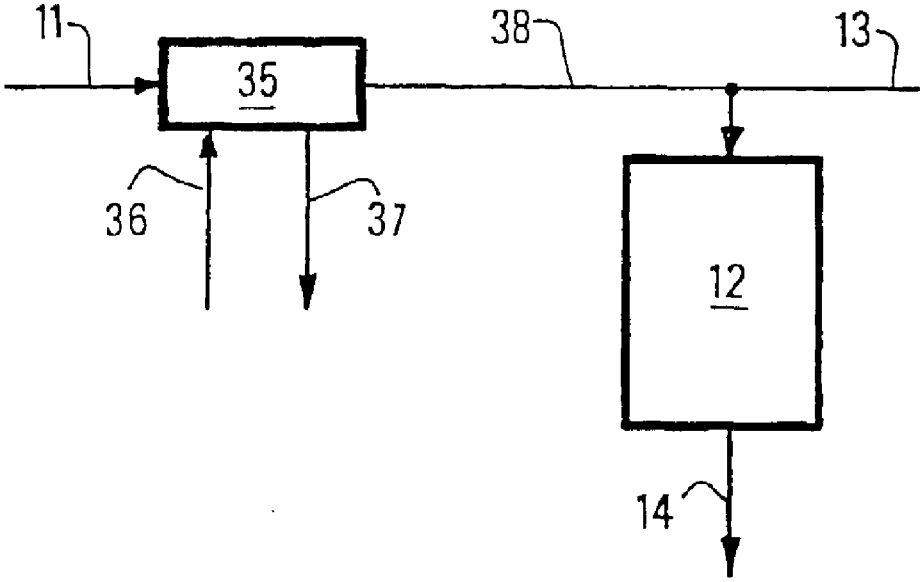
FIG. 4 illustrates an embodiment including a solvent extraction stage for removing a portion of aromatics.

This variant (corresponding to stage (c') of the process) is shown in FIG. 4. The upstream and downstream treatments are those of the process as illustrated in, for example, FIG. 2 or 3.

Thus, the invention also relates to an installation for the production of high quality oils and optionally high quality middle distillates, comprising:

- at least one hydrotreatment zone (2) that contains at least one hydrotreatment catalyst and is equipped with at least one pipe (1) for introducing feedstock and at least one pipe (3) for introducing hydrogen,
- at least one hydrocracking zone (5) that contains at least one hydrocracking catalyst for treating the hydrotreated effluent that is obtained from zone (2), whereby the hydrocracked effluent exits zone (5) via a pipe (6), at least one atmospheric distillation column (9) for treating the hydrocracked effluent, and is equipped with at least one pipe (10) for the output of the gaseous fraction, at least one pipe (11) for the output of a liquid fraction (residue) that contains compounds with boiling points of higher than 340° C., at least one pipe (28, 29 or 30) for the output of at least one distillate, at least one unit for extracting aromatic compounds (35) for treating the residue, equipped with at least one pipe (35) for providing the solvent from at least one pipe (36) for its output, and from at least one pipe (38) for the output of the raffinate, at least one catalytic dewaxing zone (12) that contains at least one dewaxing catalyst, in which the raffinate enters, and the hydrogen is admitted via at least one pipe (13), whereby zone (12) is equipped with at least one pipe (14) for the output of the dewaxed effluent, at least one hydrofinishing zone (15) for treating the dewaxed effluent by a hydrofinishing catalyst, whereby the effluent exits via at least one pipe (16), at least one distillation zone comprising at least one atmospheric distillation column (19) and at least one vacuum distillation column (20), whereby column (19) is equipped with at least one pipe (26) for the output of light gases, at least one pipe (23, 24 or 25) for the output of at least one distillate, and at least one pipe (21) for recovering a residue, whereby column (20) comprises at least one pipe (22) for the output of the oil fraction and at least one pipe (27) for the output of other compounds.

In another embodiment, an installation is described in which zones (2) and (3) are located in the same reactor that is equipped with at least one pipe (1) for the input of the feedstock, at least one pipe (3) for the input of hydrogen, and at least one pipe (6) for the output of hydrocracked effluent, whereby said installation also comprises at least one additional hydrocracking zone (32) that is equipped with at least one pipe (11) for the admission of the residue that is obtained from atmospheric distillation column (9) and at least one pipe (33) for the output of the thus hydrocracked effluent, whereby said pipe (33) empties into pipe (6) for recycling said effluent, and in addition the installation comprises at least one pipe (34) that is located in pipe (11) for transferring the residue to extraction unit (35).

What is claimed is:

1. Process for the production of oils and optionally high quality middle distillates from a hydrocarbon feedstock including at least 20% of end volume above 340° C., process that successively comprises the following stages:

(a) Hydrotreatment carried out at a temperature of 330–450° C., under a pressure of 5–25 MPa, with a volumetric flow rate of 0.1–6 $h^{-1}$, in the presence of hydrogen in the hydrogen/hydrocarbon volumetric ratio of 100–2000, and in the presence of an amorphous catalyst that comprises at least one metal of group VIII and at least one metal of group VI B, (b) Hydrocracking, without intermediate separation of the effluent that is obtained at the end of the hydrotreatment, whereby the hydrocracking is carried out at a temperature of 340–430° C., under a pressure of 5–25 MPa, with a volumetric flow rate of 0.1–5 $h^{-1}$, in the presence of hydrogen, and in the presence of a catalyst that contains at least one zeolite and that also contains at least one element of group VIII and at least one element of group VI B, (c) atmospheric distillation of the effluent that is obtained at the end of the hydrocracking to separate the gases from the liquid, and to recover at least one liquid fraction that contains compounds with a boiling point of higher than 340° C., (d) whereby said fraction is treated directly by catalytic dewaxing at a temperature of 200–500° C., under a total pressure of 1–25 MPa, with an hourly volumetric flow rate of 0.05–50 $h^{-1}$, with 50–2000 l of hydrogen/l of feedstock, in the presence of a catalyst that also comprises at least one element with a hydrodehydrogenating function and at least one zeolite that is selected from the group that is formed by zeolites ZSM-48, EU-12, EU-11 and ZBM-30, (e) the dewaxed effluent is directly subjected to a hydrofinishing treatment that is carried out at a temperature of 180–400° C., which is lower than the catalytic dewaxing temperature by at least 20° C. and at most 200° C., under a total pressure of 1–25 MPa, with an hourly volumetric flow rate of 0.05–100 $h^{-1}$, in the presence of 50–2000 liters of hydrogen/liter of feedstock, and in the presence of an amorphous catalyst for the hydrogenation of aromatic compounds, comprising at least one metal that is selected from the group of metals of group VIII and metals of group VI B, (f) the effluent that is obtained from the hydrofinishing treatment is subjected to a distillation stage that comprises an atmospheric distillation and a vacuum distillation so as to separate at least one oil fraction at a boiling point of higher than 340° C. and that has a pour point of lower than −10° C., a content by weight of aromatic compounds of less than 2% and a VI of greater than 95, a viscosity at 100° C. of at least 3 cSt (or 3 $mm^2/s$) and so as optionally to separate at least one middle distillate fraction that has a pour point of less than or equal to −20° C., a content of aromatic compounds of at most 2% by weight and a content of polyaromatic compounds of at most 1% by weight.

2. A process according to claim 1, wherein the hydrofinishing catalyst of stage (e) comprises an amorphous substrate, at least one noble element of group VIII, chlorine and fluorine.

3. A process according to claim 1, wherein hydrotreatment stages (a) and hydrocracking stages (b) are carried out in the same reactor.

4. A process according to claim 1, wherein hydrotreatment stages (a) and hydrocracking stages (b) are carried out in different reactors.

5. A process according to claim 1, wherein during stage (c) of atmospheric distillation, a residue with an initial boiling point of higher than 370° C. is obtained that then undergoes the catalytic dewaxing of stage (d).

6. A process according to claim 5, further comprising recycling the hydrocracking residue at least in part to at least one of the hydrotreatrnent stage and the hydrocracking stage.

7. A process according to claim 5, further comprising subjecting at least a portion of the hydrocracking residue to an additional hydrocracking stage that is different from stage (b), whereby the effluent that is obtained is recycled to atmospheric distillation stage (c), and the other portion of the residue is treated in dewaxing stage (d).

8. A process according to claim 5, further comprising subjecting the residue obtained from the atmospheric distillation of stage (c) to an extraction of aromatic compounds (stage c'), and catalytically dewaxing the resultant residue in stage (d).

9. A process according to claim 1, resulting in the production of white oils that have aromatic compound contents of less than 0.01% by weight.

10. A process according to claim 6, further comprising subjecting the residue obtained from the atmospheric distillation of stage (c) to an extraction of aromatic compounds (stage c'), and catalytically dewaxing the resultant residue in stage (d).

11. A process according to claim 7, further comprising subjecting the residue obtained from the atmospheric distillation of stage (c) to an extraction of aromatic compounds (stage c'), and catalytically dewaxing the resultant residue in stage (d).

12. A process according to claim 5, wherein the hydrofinishing catalyst of stage (e) comprises an amorphous substrate, at least one noble element of group VIII, chlorine and fluorine.

13. A process according to claim 6, wherein the hydrofinishing catalyst of stage (e) comprises an amorphous substrate, at least one noble element of group VIII, chlorine and fluorine.

14. A process according to claim 7, wherein the hydrofinishing catalyst of stage (e) comprises an amorphous substrate, at least one noble element of group VIII, chlorine and fluorine.

15. A process according to claim 8, wherein the hydrofinishing catalyst of stage (e) comprises an amorphous substrate, at least one noble element of group VIII, chlorine and fluorine.

16. A process according to claim 9, wherein the hydrofinishing catalyst of stage (e) comprises an amorphous substrate, at least one noble element of group VIII, chlorine and fluorine.

17. A process according to claim 10, wherein the hydrofinishing catalyst of stage (e) comprises an amorphous substrate, at least one noble element of group VIII, chlorine and fluorine.

18. A process according to claim 11, wherein the hydrofinishing catalyst of stage (e) comprises an amorphous substrate, at least one noble element of group VIII, chlorine and fluorine.

19. A process according to claim 1, wherein step (f) is conducted so as to separate said middle distillate.

20. A process according to claim 1, wherein the hydrofinishing treatment of step (e) is conducted at a temperature lower than the catalytic dewaxing temperature by 30–100° C.

21. A process according to claim 1, wherein the at least one zeolite employed in the catalyst in dewaxing step d) is ZSM-48.

22. A process according to claim 20, wherein the at least one zeolite employed in the catalyst in dewaxing step d) is ZSM-48.

23. A process according to claim 1, wherein the at least one zeolite employed in the catalyst in dewaxing step d) is EU-2, EU-11 or ZBM-30.

24. A process according to claim 20, wherein the at least one zeolite employed in the catalyst in dewaxing step d) is EU-2, EU-11 or ZBM-30.

* * * * *